United States Patent [19]

Hall, II

[11] Patent Number: 4,802,501

[45] Date of Patent: Feb. 7, 1989

[54] PORTABLE SHELTER

[76] Inventor: James W. Hall, II, 517 Carroldale SE., Canton, Ohio 44707

[21] Appl. No.: 76,056

[22] Filed: Jul. 21, 1987

[51] Int. Cl.[4] ..... E04H 15/48

[52] U.S. Cl. ..... 135/109; 135/DIG. 9

[58] Field of Search ..... 135/109, DIG. 9, 101

[56] References Cited

U.S. PATENT DOCUMENTS

| | | | |
|---|---|---|---|
| 3,604,439 | 9/1971 | Thomka | 135/109 X |
| 4,066,089 | 1/1978 | Rainwater | 135/DIG. 9 |
| 4,244,384 | 1/1981 | Bean | 135/109 X |
| 4,347,690 | 9/1982 | Wallace | 135/DIG. 9 |
| 4,393,887 | 7/1983 | Orobin | 135/109 |

*Primary Examiner*—J. Karl Bell

*Attorney, Agent, or Firm*—David E. Wheeler

[57] ABSTRACT

A frame for a shelter, a shelter and structural members used to make the frame are provided. The structural members are cruciform in cross section and have swivel means which are used to connect structural members to other structural members to construct the frame of the invention. The swivel means used can be of several different types. The swivel means on the structural members make it possible to fold a frame constructed from the structural members into a small package. The structural members can be uniformly constructed, their function in the frame depending on where they are used in the frame and the particular swivel means used in their attachment. A covering is used to cover the frame and the frame and the covering together represent the shelter of the invention.

28 Claims, 4 Drawing Sheets

PORTABLE SHELTER

BACKGROUND OF THE INVENTION

The present invention relates to a collapsible portable shelter or storage area.

1. Prior Art

Bouck, in U.S. Pat. No. 1,635,814 teaches a canopy for an automobile which is adapted to be supported on a frame which is detachably mounted to a vehicle.

Berbeck, in U.S. Pat. No. 1,777,028 teaches a portable building with special reference to a portable knock-down garage. The patent describes a wood frame structure which may be covered with canvas or another covering material, in which the members of the wood frame structure are held together with sockets and socket engaging fingers.

Comber, in U.S. Pat. No. 2,523,195 teaches a tent which is held together by a collapsible framework which may be used in camping, and packed and transported as desired. The frame structure is preferably braced by tie connections and angle braces, and forms a rigid support for the body of the tent.

Collins, in U.S. Pat. No. 2,835,262 teaches portable shelters having a roof frame comprising a plurality of tubular bar sections and connector fittings for detachably joining the bar sections.

Griffith, in U.S. Pat. No. 3,600,866 teaches a portable garage for a trailer camp comprising a walled enclosure having a main hinged door at its entrance-exit end. The garage is designed to be hitched to a towing car for traveling.

Tisma, in U.S. Pat. No. 4,228,622 teaches an automobile shelter apparatus comprising an open ended housing to cover the hood portion of an automobile, and an attached frameless covering which is used to cover the remainder.

2. Background

The most popular method used by car owners who do not have garages to protect their cars is a car cover. Although they are a relatively inexpensive means of protecting a car, even in good weather they are bulky and difficult to handle, and when covered with snow or ice, they are very cumbersome to remove and store. To avoid the ritual of removing a car cover in the morning and putting the cover on the car in the evening and to avoid the expense of a conventional frame shelter, which is not practical for a large number of people who live in apartments, it is preferable to provide an inexpensive shelter which stands above the car so that the car can be driven into and out of the shelter whereby the car is kept clean in inclement weather and the owner does not have to bother with cleaning snow and ice off the car, or bother with cumbersome covers before driving.

It is known in the art to make an inexpensive shelter or storage area by building an inexpensive frame and covering the frame with canvas or plastic. Some such structures, for example tents, are also designed to be set up or pitched, and to be broken down and made portable. There is no structure known in the prior art which combines the feature that it is suitable for storing a car inexpensively; and has features which make possible the relatively simple assembly and disassembly of the frame; and has an inexpensive water resistant plastic covering; and can be collapsed into a small bundle of a size convenient to be carried in the trunk of a car.

It is the object of the present invention to overcome the deficiencies of the prior art structures.

SUMMARY OF THE INVENTION

A prefabricated, collapsible, portable shelter frame is provided. The shelter frame has vertical members, for supporting the side of the shelter, having a first end anchored directly or indirectly to the ground; a horizontal side member attached to a second end of the vertical member tying vertical two members together; a roof support member having one end attached also to the second end of the vertical member, forming an obtuse angle with the vertical member, providing support for the shelter roof. The second end of the roof support member is attached to an apex member which ties roof support members together. The vertical member, horizontal side member, roof support member, and apex members are attached to each other by swivel means. In the preferred embodiment, a second roof support member is attached to each roof support member and the apex member to form a gable. Also in the preferred embodiment, the swivel means between the vertical member and the first roof support member and between the first roof support member and the second roof support member is a locking hinge. Likewise, a swivel between the vertical member and the horizontal side member and between the roof support member and the apex member includes a hinge and sleeve member that provides for 360 degree rotation of the horizontal side member and the apex member with respect to the vertical member and the roof support member respectively. In addition, the vertical member, roof support member, apex member and horizontal side member may have a locking hinge between their respective ends so that each said member may be folded at or near its middle. Using the various hinges, the shelter frame of the invention may be folded into a small package.

Also provided is a prefabricated, collapsible, portable shelter which comprises the shelter frame of the invention and a prefabricated water resistant covering adapted to fit over the shelter frame.

Also provided are structural members which are used in constructing the shelter frame of the invention.

DESCRIPTION OF THE ILLUSTRATED EMBODIMENTS

Figure 1:
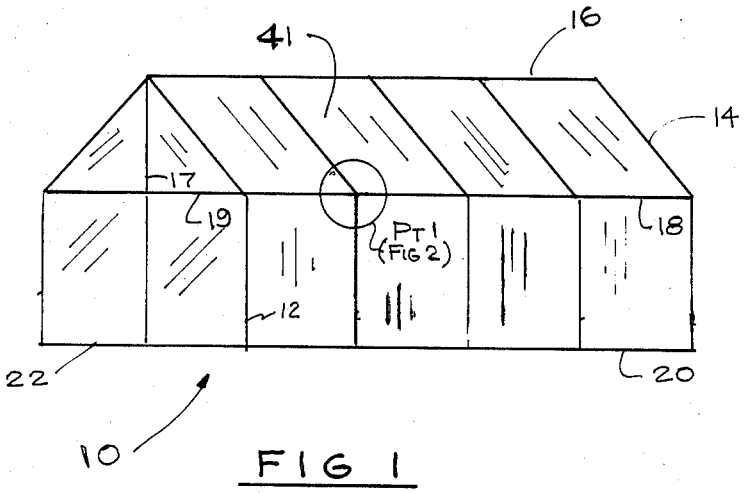
FIG. 1 illustrates the shelter frame of the invention in its preferred shape having a gable shaped roof.

With reference now to FIG. 1, in its illustrated embodiment, the shelter frame 10 of the invention comprises vertical members 12, which provide support for the roof and provide for support of a covering material on the sides of the shelter frame 10, having a first end connected directly or indirectly to the ground; roof support members 14, which provide support for a covering material on the roof of the shelter frame 10, having a first end attached to a second end of said vertical member; apex member 16, which provides support for opposed roof support members 14 from each side of the roof and ties roof support members 14 together at the top of the roof, attached to a second end of said roof support member; horizontal side member 18 which ties roof support members 14 together at the first end thereof where they meet vertical members 12, and tie vertical members 12 together at the second end thereof. In the preferred embodiment, cross ties 19 will provide additional support for the vertical side members 12 by tying together vertical members on opposite sides of the shelter frame 10. In one possible embodiment of the invention, shelter frame 10 may also have bottom side members 20 to tie vertical members 12 together at the bottom of shelter frame 10 and bottom end members 22 which tie opposed vertical side members 12 together at the bottom thereof. As a further option, a support strut 17 may be provided to tie apex member 16 to cross ties 19.

As used herein, opposed is used to refer to left and right mirrored members. That is, when entering the shelter, the shelter frame members on the left side will be opposed to its opposite member on the right side.

Those skilled in the art will recognize that instead of using bottom side members 20 and bottom end members 22, that each vertical member 12 may be anchored individually to the ground by any means known in the art. For example, vertical members 12 may be provided with spiked ends and may be driven into the ground. Accordingly, vertical members 12 may be directly attached to the ground (having a spiked end) or indirectly attached to the ground (attached to a bottom member 22).

Figure 2:
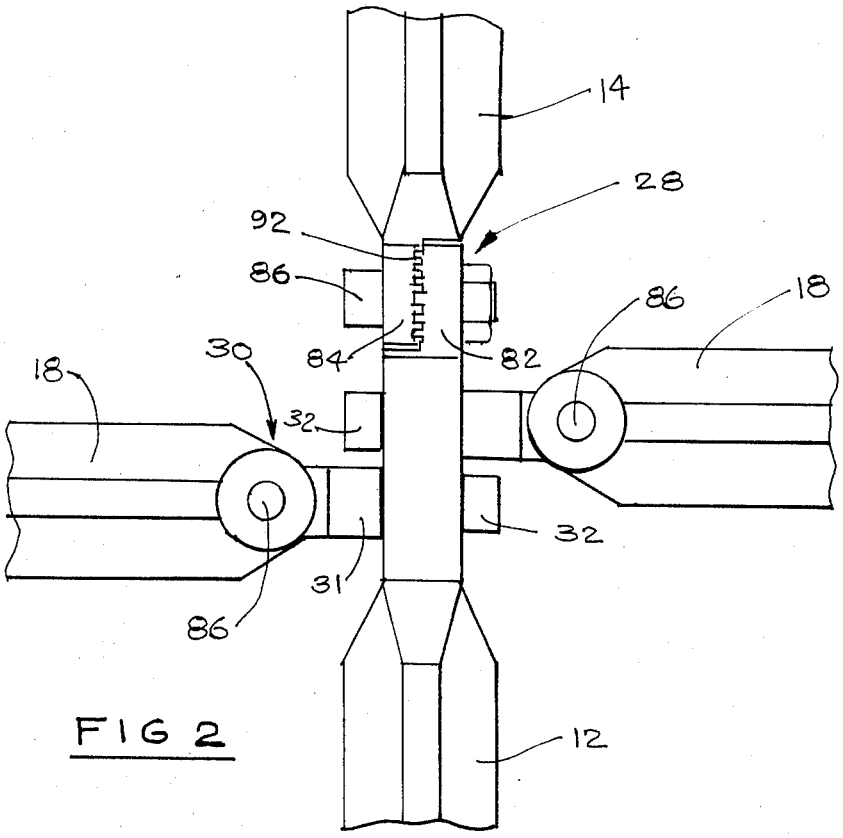
FIG. 2 illustrates a front of view the connection between frame member at point 1 in FIG. 1 along line 2—2.
Figure 3:
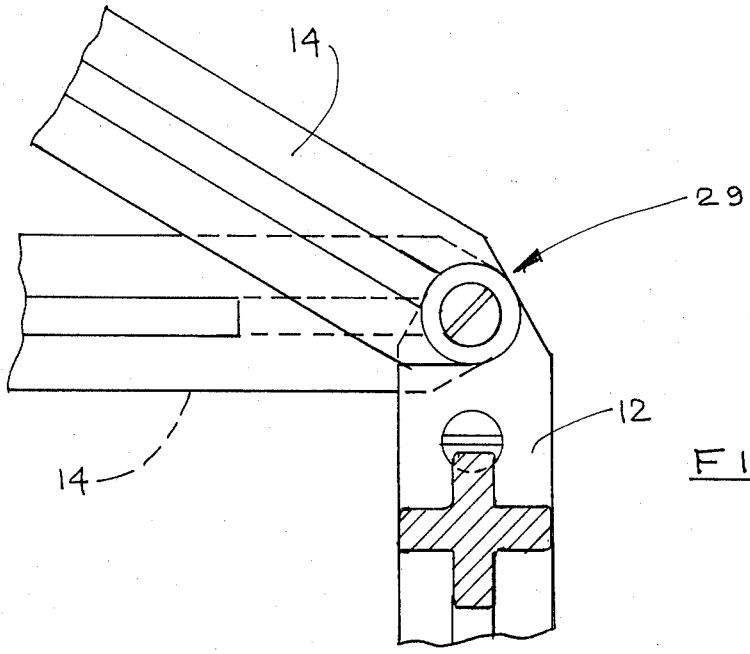
FIG. 3 is a side view of the connection between the frame member at point 1 in FIG. 1 along the line 3—3.
Figure 5:
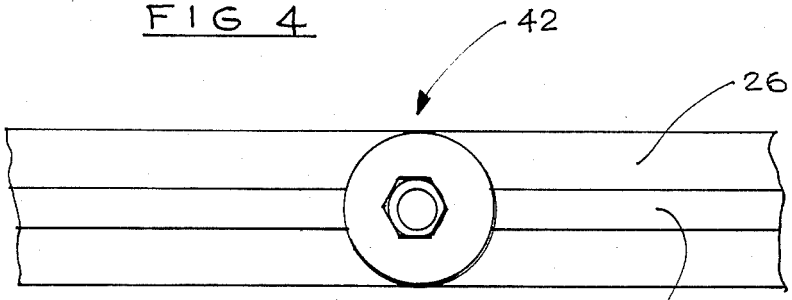
FIG. 5 is an illustration of the locking hinge within frame members at points 2 and 3 in FIG. 1.

With reference now to FIGS. 2 and 3, in the illustrated embodiment of the invention, vertical side members 12 and roof support members 14 will be connected together by a locking hinge means 28. Similarly, opposed roof support members 14 will be connected together by the similar locking hinge arrangement 29. Also, with reference to FIG. 5, each vertical member 12, roof support member 14, apex member 16, horizontal side member 18, cross tie 19, bottom side member 20 (when used), and bottom end member 22 (when used) may have a locking hinge 42 in the mid section thereof.

Since the angle of the locking hinge may be varied, the locking hinge makes it possible to standardize the manufacture of the various members used in the shelter frame. That is, in the illustrated embodiment, the vertical members 12, apex members 16, horizontal side members 18, cross ties 19, bottom side members 20, and bottom end members 22, will all have the same dimensions and will be interchangeable, and their function in the shelter frame will be dependant only on how they are attached to the other members of the frame and the angle at which the locking hinge is locked into position. Roof support members 14 will be slightly longer than the other members of the frame in the case where a gabled roof is desired on the shelter.

The locking hinge may be locked into position with the opposed members having an obtuse angle of about 100 to about 140 degrees relative to each other when the two members are roof members, and will be locked with an obtuse angle of about 100 to 140 degrees when the two connected members are a roof member and a vertical member, and will be locked at an angle of 180 degrees when used in the middle of an individual member.

In the illustrated embodiment, the angle between opposed roof support members 14 will be about 120 degrees. This angle will permit minimum slope of the gable when the vertical side member 12 is about seven feet long, for example, and roof support member 14 is about five feet long. Similarly, the locking hinge between vertical side members 12 and roof support member 14 will be set such that these members are at an angle of about 120 degrees relative to each other.

In the illustrated embodiment, the interchangable structural members that make up the vertical members 12, apex member 16, horizontal side member 18, cross ties 19, support strut 17, bottom side member 20, and bottom end member 22 will each be about 30 inches long. Accordingly, a vertical side member will comprise three such structural members and will be about 7½ feet long. Cross tie 19 will comprise four such structural members and will be about 10 feet long. Horizontal side member 18 and apex member 16 will comprise eight such members and will be about 20 feet long. Because of the swivel attachment (ball hinge 30, sleeve 31, and bolt 32) of the apex member 16 and the horizontal side member 18 to the vertical member 12 and roof member 14, the apex member 16 and horizontal side members 18 will comprise four integral sets of structural members each having two structural members attached to each other through a locking hinge being set at an angle of 180 degrees. Support strut 17 will comprise one such structural member.

In order to make roof support members 14 long enough to form a gabled roof, structural members may be provided having a length of 24 inches or 36 inches, and roof support member 14 may comprise three or two of such structural members, respectively, on each side of the apex of the roof.

It will be recognized by those skilled in the art that structural members having various lengths may be interchanged in a shelter frame to provide a shelter having dimensions particularly suited for use by a particular person.

Also, apex member 16 and horizontal side member 18 will be connected to roof support members 14 and vertical members 12 in a swivel (sleeve 31) and ball hinge or wheel and axel hinge arrangement 30.

As used herein, the term swivel means is used generically to include locking hinges, ball hinges, sleeves, etc.

Figure 4:
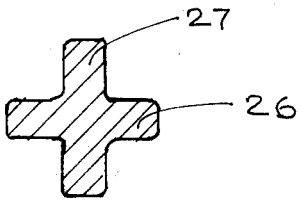
FIG. 4 is a cross section of a frame member.

To assure that the shelter frame is lightweight, yet strong, the shelter frame members will be made from lightweight material, such as aluminum or plastic, and in the illustrated embodiment, with reference to FIG. 4, will have a cross section configuration which will provide maximum strength using a minimum amount of material. For example, as illustrated in FIG. 4, the members may comprise cruciform side bars 26 and 27 which provide structural support to the member in opposition to stress from any direction.

Although illustrated as having two intersecting side bars 26 and 27, to provide four members in cross section being disposed at a 90 degree angle relative to each other, it will be recognized by those skilled in the art that the shelter members may also have a three, five or six member cross sections and achieve similar results.

The 360 degree rotation of horizontal side member 18 and apex member 16 made possible by the sleeve-hinge arrangement makes possible the compact folding of the frame members when the frame is collapsed since the angular side bars 26 and 27 on the respective frame members may be rotated into a position where they intermesh when folded together. The various swivel means will make possible the folding and collapsing of the shelter frame members into a small, lightweight package that can be easily transported.

Figure 8:
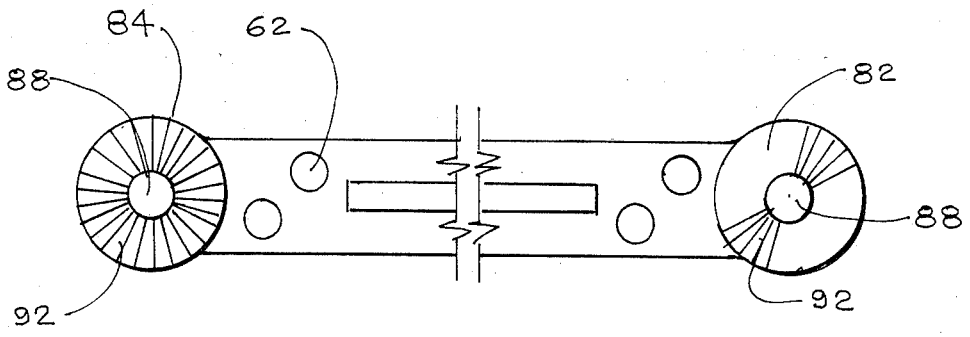
FIG. 8 illustrates a structural member used in the frame member of the invention.

With reference to FIGS. 2, 3 and 8, using for purpose of illustration the point of intersection between vertical members 12, roof members 14 and horizontal side members 18, the locking hinge 28 may comprise side by side wheels 82 and 84, and a means for locking said wheels in a fixed relationship, such as interlocking gears 92 or similar means. Means is also provided for holding the gears of the locking hinge in position when the angle of disposition of the locking hinge for its specific purpose is determined. Such means may comprise a bolt, nut and washer system associated with the center of the hinge or may comprise an overlapping arm in the case when the locking hinge is set at 180 degrees.

The horizontal side member 18, which is physically the same as the apex member 16, is adapted to turn in a 360 degree angular rotation with respect to the vertical member 12 by means of swivel 31 which permits rotation of the horizontal side member 18 on bolt 32. Also, horizontal side member 18 has associated therewith a wheel and axel hinge 30 in which one member of the hinge comprises an wheel attached to, for example, the horizontal side member 18, and the other member of the hinge comprises a wheel attached to swivel 31 and the axel comprises bolt 86 passing through the center of both wheels. Other means for providing the swivel means will be apparent to those skilled in the art.

Figure 6:
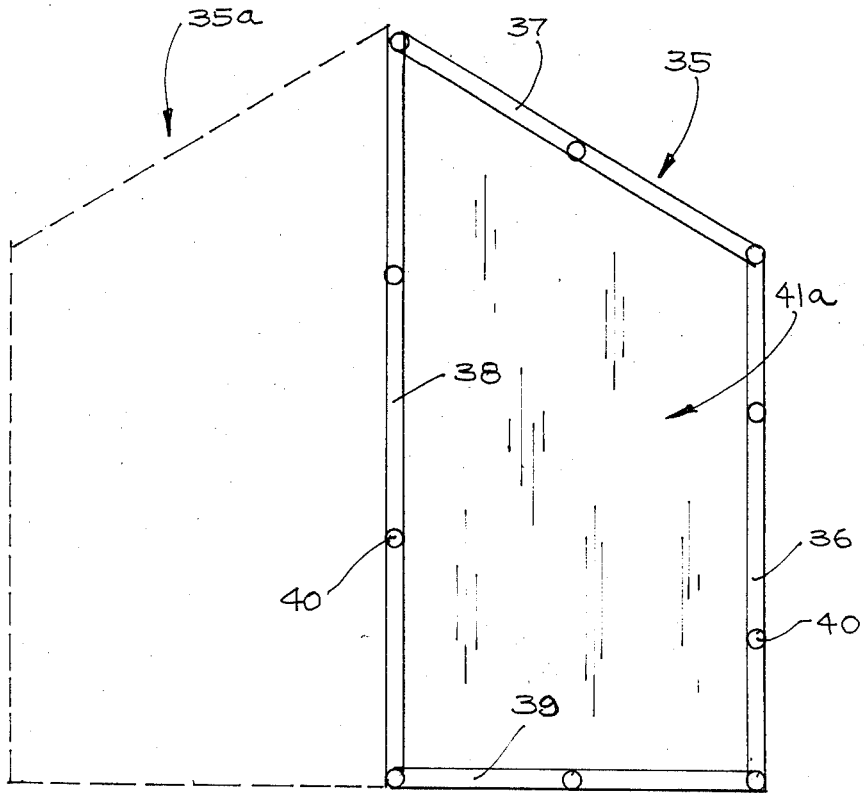
FIG. 6 illustrates the preferred door arrangement for the shelter frame.

With reference now to FIG. 6, in the illustrated embodiment the frame of the shelter door will be made of frame members similar to those used in the main portion of the shelter and will be configured to allow for two outwardly opening doors. Those skilled in the art will recognize that other door configurations may be used.

A door 35, intended for attachment to shelter 10 comprises a side door frame member 36 which is adapted for swinging attachment to a vertical side member 12 of the shelter frame 10, a top door member 37 which may be adapted for closing attachment to a roof support member 14, a center door member 38 which may be adapted for closing attachment to a similar opposed door 35a, and a bottom door member 39 which optionally may be adapted for attachment to a bottom end member 22. The door frame may be covered with a water resistant material 41a, which preferably will be the same kind of material used to cover shelter frame 10. The various door frame members may be attached to oneanother by any means known to those skilled in the art, and in the illustrated embodiment are connected by locking hinges similar to those described in FIG. 5. The angular relationship of the door members at the locking hinges in the door frame 35 will be determined empirically to match the similar angled members of shelter frame 10 to provide closure of the shelter by aligning door frame members with matching shelter frame members.

Figure 7:
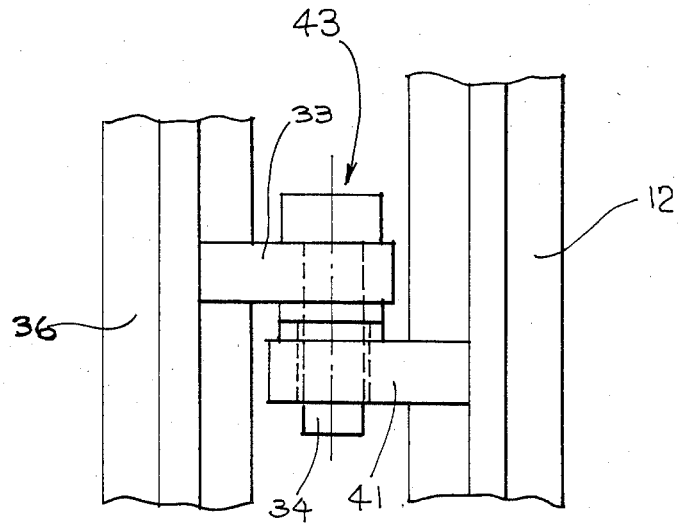
FIG. 7 illustrates a hinge arrangement which can be used with the shelter door of the invention.

With reference now to FIG. 7, the door frame will be hinged to the shelter frame by a post hinge 43 in which a strut 41 having a hole (not shown) for receiving a post 34 is attached to, for example, a vertical member 12. The post 34 is attached to a supporting strut 33 which is attached to a door frame member 36. The post 34 is rotatable within the hole of strut 33 which makes possible the swinging closing and opening of door 35. The door frame 35 may have two, three or four such hinges as may be determined necessary by the weight of the door and the strength of the struts 33 and 41 and post 34 used to make the post hinge 43.

Cross braces may be provided between any two frame members in the shelter frame or door frame, for example, connecting a vertical member 12 at a point below the swivel hinge arrangement connecting vertical member 12 to horizontal side member 18, to horizontal side member 18 at a point beside said swivel hinge arrangement to provide additional structural support as needed.

In the illustrated embodiment, small strips of velcro 40 will be attached to roof support member 14 adjacent to the door members and to the door members and will be used as means for latching or holding the door closed. Those skilled in the art will recognize that other means may be provided for sealing or holding the shelter door shut.

In the preferred embodiment, the covering for the shelter frame will be a clear plastic material. The cover 41 may be pre-cut to size and be adapted to be slid over the frame when the frame has been assembled, and the cover will have means for attachment to the shelter frame. In one embodiment, small strips of velcro may be glued to the cover and the frame and aligned to hold the cover in place. In other embodiments, snaps or other means may be used to hold the plastic cover to the shelter frame.

Optionally, a sheet of covering material may be provided to cover the floor of the shelter. Such a sheet will help prevent moisture from the ground from increasing the humidity in the shelter, and in the case where the shelter is used to protect an automobile, the sheet of covering material will help prevent contamination of the ground from dripping oil and the like.

The collapsible shelter of the invention comprises the shelter frame as herein described together with a waterproof covering over the shelter frame. In the illustrated embodiment, the shelter of the invention has a gabled roof and two swinging doors 35 which are sized to cover one end of the shelter and swing outward to provide easy access to the interior of the shelter. The shelter is adjustable as to size since the shelter owner may choose interchangable structural members of various sizes to construct the frame of the shelter. In the preferred embodiment, the waterproof covering 41 of the garage will be an inexpensive transparent plastic material. The waterproof covering 41 may be attached to the shelter frame using velcro strips, or by any other means known to those skilled in the art.

Although illustrated and described for use as a shelter for an automobile, those skilled in the art will recognize that the shelter of the invention may be used for any purpose for which any collapsible, portable shelter can be used. For example, the shelter of the invention can be used as a shelter for lawn tools and such, or as a tent.

With reference now to FIG. 8, the structural members of the invention comprise cruciform or similar cross-sectioned members having a first end having a wheel 82 with locking gears 92, or similar locking means, and a hole 88 for receiving a bolt 86, and a second end having a wheel 84 with locking gears 92, or a similar locking means, and a hole 88 for receiving a bolt 86. The locking means on the structural members are adapted to be locked at a number of different angles of between 0 and 360 degrees. Both or preferably one of wheels 82 and 84 may have threads for receiving a bolt 86 which is used for holding the locking hinge in the locked position. As will be recognized by those skilled in the art, wheels 82 and 84 may be made without threads and may be held in position by a nut and a bolt.

In the case where the structural member is used in a sleeve-wheel and axel hinge-swivel arrangement, a connecting member 52 may be attached to a wheel 82, for example, using a bolt 86.

Figure 9:
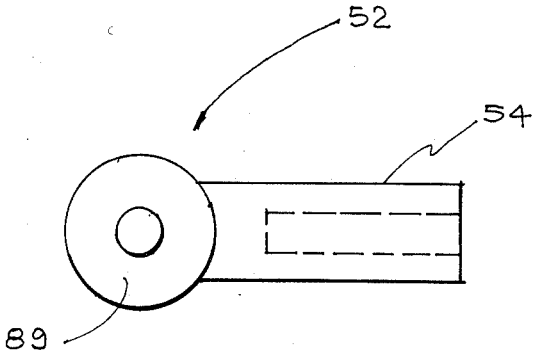
FIG. 9 illustrates a connecting member used in a ball hinge-sleeve-swivel arrangement of the invention.

With reference to FIG. 9, the connecting member 52 preferably will comprise a wheel 89, and a sleeve 54 which is attached to bolt 32 in such a manner that the bolt 32 and sleeve 54 are rotatable within hole 62 (FIG. 2) in, for example, vertical member 12.

Other means for providing this or a similar swivel arrangement will be apparent to those skilled in the art.

While specific embodiments of the invention have been illustrated and described, those skilled in the art will recognize that other embodiments of the invention may be employed without departing from the spirit of the invention as embraced by the following claims.

What is claimed is:

1. A prefabricated, collapsible, portable shelter frame comprising (a.) a bottom side member for supporting the bottom of said frame (b.) an upright vertical member for supporting the side of said frame, having a first end anchored directly or indirectly to the ground (c.) a horizontal side member attached to a second end of said vertical member and tying two vertical members together (d.) a roof support member having a first end attached to said second end of said vertical member and forming an obtuse angle with said vertical member for supporting a roof (e.) an apex member attached to a second end of said roof support member and tying two roof support members together on one side of the roof wherein said vertical member, horizontal side member, roof support member and apex members are attached to each other by swivel means wherein said swivel means between said vertical member and said horizontal side member and between said roof support member and said apex member comprises a hinge and sleeve member which provides for 360 degree rotation of said horizontal side member and said apex member with respect to said vertical member and said roof support member respectively and wherein said swivel means comprises an axel and a wheel or angular rotation between said members, and wherein said axel is attached to a rotatable sleeve for positional rotation between said members.

2. The prefabricated, collapsible, portable shelter frame of claim 1 in which a first roof support member is attached to a second roof support member and to said apex member to form a gable.

3. The prefabricated, collapsible, portable shelter frame of claim 1 in which said swivel means between said vertical member and said roof support member, and between said first roof support member and said second roof support member is a locking hinge.

4. The prefabricated, collapsible, portable shelter frame of claim 1 in which each said vertical member, roof support member, apex member, and horizontal side member has at least one locking hinge member intermediate the ends thereof.

5. The prefabricated, collapsible, portable shelter frame of claim 1 which comprises a plurality of angled sides to provide structural strength.

6. The prefabricated, collapsible, portable shelter frame of claim 5 which comprises four angled sides and said angled sides form right angles with each other.

7. The prefabricated, collapsible, portable shelter frame of claim 4 in which said bottom side member, vertical member, horizontal side member, roof support member and apex member are adapted to fold together by rotating said members on said swivel means.

8. The prefabricated, collapsible, portable shelter frame of claim 1 which comprises weather resistant covering means adapted to fit over and be attached to said frame.

9. The prefabricated, collapsible, portable shelter frame of claim 1 in which said frame members are adapted to fold together at said swivel means to fold into a small package.

10. The prefabricated, collapsible, portable shelter frame of claim 1 in which said vertical member, horizontal side member, roof support member and apex members are substantially the same size and substantially the same structure.

11. The prefabricated, collapsible, portable shelter frame of claim 10 in which the dimensions of said shelter frame can be altered by increasing or decreasing the number of frame members used.

12. The prefabricated, collapsible, portable shelter frame of claim 1 in which corner pieces are provided to connect said horizontal side members and said vertical members at points displaced from said swivel means to provide structural support for said frame.

13. The prefabricated, collapsible, portable shelter frame of claim 3 in which said locking hinge comprises an axel and wheel to provide rotation between said members, and said locking means comprises a ratchet and lever.

14. A prefabricated, collapsible, portable shelter comprising (a.) a bottom side member for supporting the bottom of a frame (b.) an upright vertical member for supporting the side of said frame, having a first end anchored directly or indirectly to the ground (c.) a horizontal side member attached to a second end of said vertical member and tying two vertical members together (d.) a roof support member having a first end attached to said second end of said vertical member and forming an obtuse angle with said vertical member for supporting a roof (e.) an apex member attached to a second end of said roof support member and tying two roof support members together on one side of the roof wherein said vertical member, horizontal side member, roof support member and apex members are attached to each other by swivel means, wherein said swivel means between said vertical member and said horizontal side member and between said roof support member and said apex member comprises a hinge and sleeve member which provides for 360 degree rotation of said horizontal side member and said apex member with respect to said vertical member and said horizontal side member respectively and wherein said swivel means comprises an axel and a wheel for angular rotation between said members, and wherein said axel is attached to a rotatable sleeve for positional rotation between said members and (f.) a weather resistant covering covering and affixed to said frame.

15. The prefabricated, collapsible, portable shelter of claim 14 in which a first roof support is attached to a second roof support member and to said apex member to form a gable.

16. The prefabricated, collapsible, portable shelter of claim 14 in which said swivel means between said vertical member and said roof support member, and between said first roof support member and said second roof support member is a locking hinge.

17. The prefabricated, collapsible, portable shelter of claim 14 in which each said vertical member, roof support member, apex member, and horizontal side member has a locking hinge member intermediate the ends thereof.

18. The prefabricated, collapsible, portable shelter of claim 14 in which the members thereof comprise a plurality of angled sides to provide structural strength.

19. The prefabricated, collapsible, portable shelter of claim 18 in which the members thereof comprise four angled sides and said angled sides form right angles with each other.

20. The prefabricated, collapsible, portable shelter of claim 17 in which said bottom side member, vertical member, horizontal side member, roof support member and apex member are adapted to fold together by rotating said members on said swivel means.

21. The prefabricated, collapsible, portable shelter of claim 14 which comprises weather resistant covering means adapted to fit over and be attached to said frame.

22. The prefabricated, collapsible, portable shelter of claim 14 in which said frame members are adapted to fold together at said swivel means to fold into a small package.

23. The prefabricated, collapsible, portable shelter of claim 14 in which said vertical member, horizontal side member, roof support member and apex members are substantially the same size and substantially the same structure.

24. The prefabricated, collapsible, portable shelter of claim 14 in which the dimensions of said shelter frame can be altered by increasing or decreasing the number of frame members used.

25. The prefabricated, collapsible, portable shelter of claim 14 in which corner pieces are provided to connect said horizontal side members and said vertical members at points displaced from said swivel means to provide structural support for said frame.

26. The prefabricated, collapsible, portable shelter of claim 16 in which said locking hinge comprises an axel and wheel to provide rotation between said members, and said locking means comprises gears on said wheel.

27. The prefabricated, collapsible, portable shelter of claim 17 in which said swivel means comprises an axel and a wheel for angular rotation between said members, and wherein said axel is attached to a rotatable sleeve for positional rotation between said members.

28. The prefabricated, collapsible, portable shelter of claim 21 in which said weather resistant covering means is attached to said frame by means of velcro strips.

* * * * *